United States Patent [19]

Lee

[11] 4,249,789

[45] Feb. 10, 1981

[54] TWIN ELECTRIC SOCKETS FOR OUTLET BOX

[76] Inventor: Hop Lee, 2455 - 24th Ave., San Francisco, Calif. 94116

[21] Appl. No.: 32,544

[22] Filed: Apr. 23, 1979

[51] Int. Cl.[3] ..... H01R 13/20; H01R 13/50

[52] U.S. Cl. ..... 339/156 R; 339/193 R; 339/209

[58] Field of Search ..... 339/122, 157 R, 158, 339/159 R, 159 C, 20, 21 R, 14, 98, 163, 164, 139, 209, 18 C, 19, 222, 155, 156, 193

[56] References Cited

U.S. PATENT DOCUMENTS

| | | | |
|---|---|---|---|
| 2,700,752 | 1/1955 | Cataldo | 339/20 X |
| 3,343,117 | 9/1967 | Carlson | 339/157 R |
| 3,355,700 | 11/1967 | Hop Lee | 339/157 R X |
| 3,917,371 | 11/1975 | Hirokawa | 339/19 |
| 4,081,206 | 3/1978 | Lee | 339/14 P |

*Primary Examiner*—John McQuade
*Assistant Examiner*—John S. Brown
*Attorney, Agent, or Firm*—Alvin E. Hendricson; William R. Piper

[57] ABSTRACT

Twin electric sockets for an electric outlet box in which three electrodes are mounted in each socket and three bus bars electrically interconnect the electrodes in one socket with their associate electrodes in the other socket. A common base supports both sockets and it has two slots for removably receiving two of the bus bars. The ends of these two bus bars are bent so as to extend upwardly in the two sockets and these upturned ends receive their associate electrodes and make electrical connection therewith when the electrodes are mounted in the sockets. The third bus bar is inserted into a longitudinally extending slot in the base by means of an opening in the base that is in registration with the longitudinal slot. This third bus bar as an integral loop at one end for receiving an integral tongue on the third electrode when it is inserted into its associate socket. The opposite end of the third bus bar is frictionally engaged by an electrode in the other socket that has an integral yoke.

2 Claims, 8 Drawing Figures

FIG. 6.
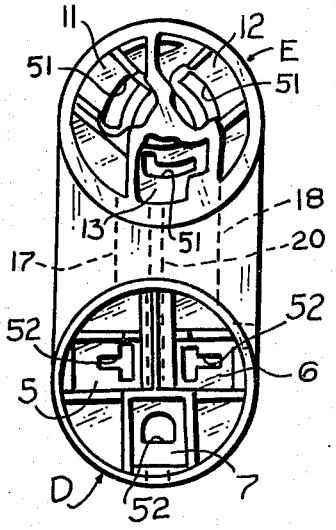
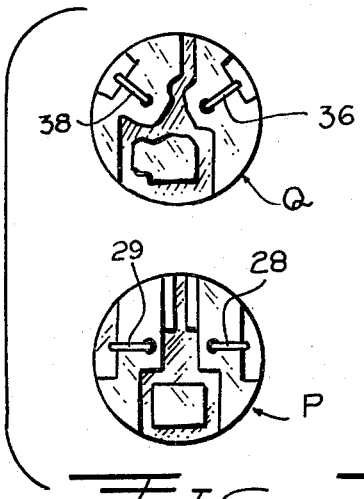
FIG. 7.
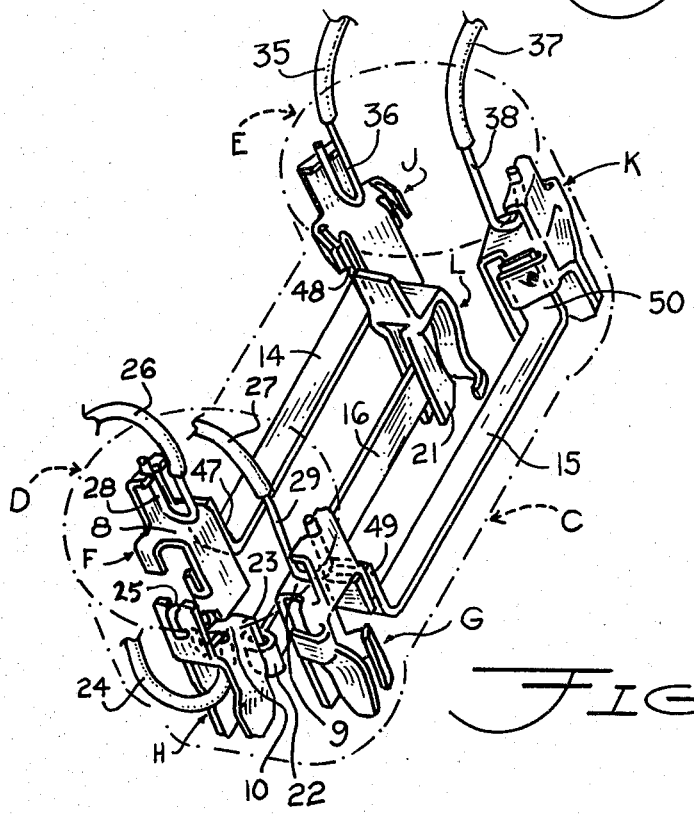
FIG. 8.

TWIN ELECTRIC SOCKETS FOR OUTLET BOX

CROSS REFERENCE TO RELATED APPLICATION

A copending patent application on an electric outlet box containing twin electric sockets was filed in the Patent and Trademark Office on Apr. 23, 1979, Ser. No. 32,545, now U.S. Pat. No. 4,211,464. In that application I set forth and claim the novel means for securing and correctly positioning the twin electric sockets in the outlet box. In the present application I illustrate the same electric outlet box as shown in my copending case and I further show the novel electrical hook-up between the two electric sockets.

SUMMARY OF THE INVENTION

An object of my invention is to provide twin electric sockets in which metal bus bars electrically connect the three electrodes of one socket with their associate three electrodes in the other socket. The twin sockets have a common base which is receivable in the electric outlet box and the base has three slots for receiving the bus bars. When the electrodes are mounted in their respective sockets they are automatically connected to their associate bus bars.

BRIEF DESCRIPTION OF THE DRAWINGS

FIG. 6 is a top view of the twin sockets when looking in the direction of the arrows 6—6 in FIG. 3.

FIG. 7 is an end view of the two wire supporting members when looking in the direction of the arrows 7—7 of FIG. 3.

FIG. 8 is an isometric phantom view of the twin electric sockets shown by dot-dash lines and the electrodes and bus bars are shown electrically interconnected with the wires being connected to the electrodes.

DESCRIPTION OF THE PREFERRED EMBODIMENTS

Figure 1:
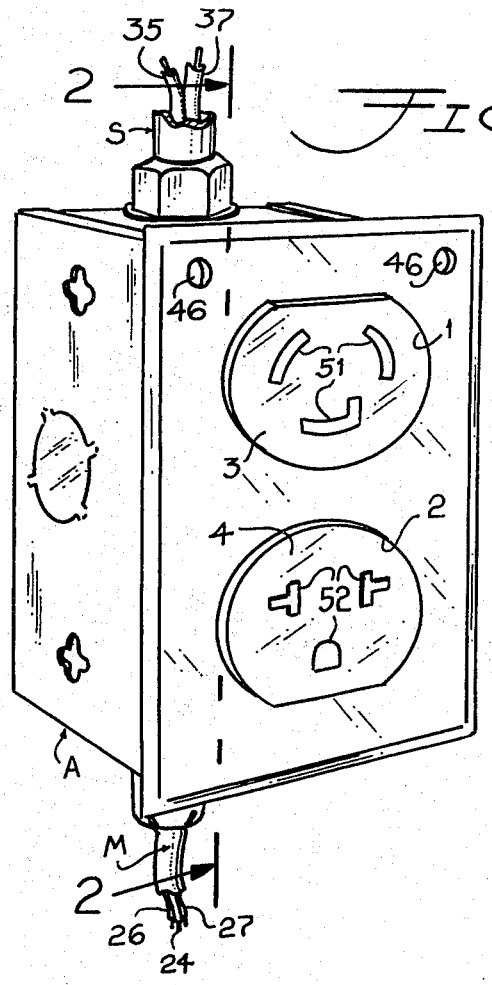
FIG. 1 is an isometric view of my electric outlet box and it houses the twin electric sockets.
Figure 2:
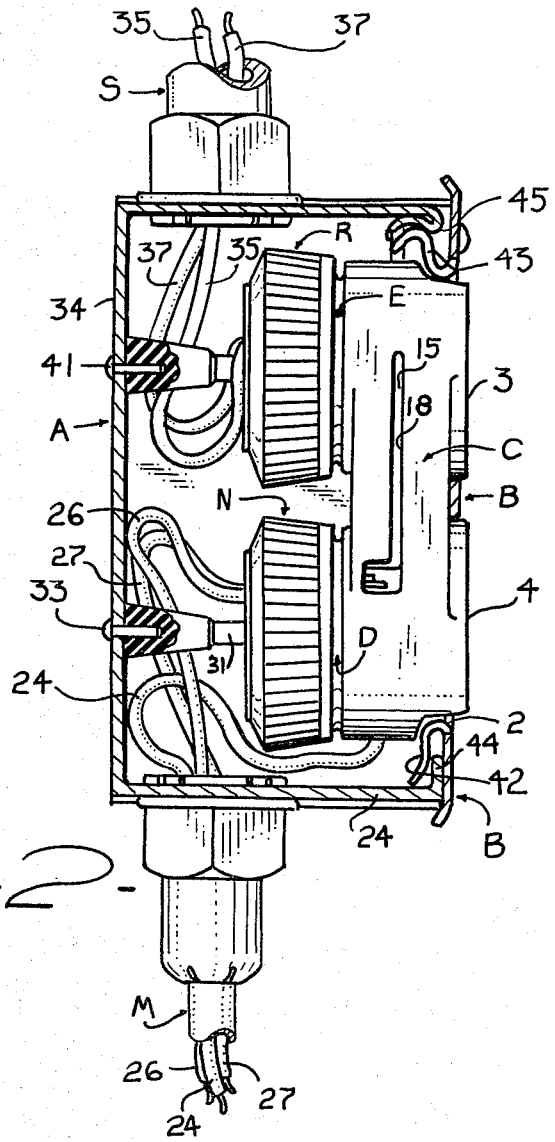
FIG. 2 is an enlarged section through the electric outlet box and it is taken along the line 2—2 of FIG. 1. The twin electric sockets are shown in elevation.

In carrying out my invention I provide an electric outlet box indicated generally at A in FIGS. 1 and 2. The box has an open top which is closed by a snap-on cover B. The cover has two openings 1 and 2 for receiving the outlet ends 3 and 4 of the twin electric socket base C. The box A has been described in detail in my copending patent application, Ser. No. 32,545, now U.S. Pat. No. 4,211,464.

Figures 3, 4, 5:
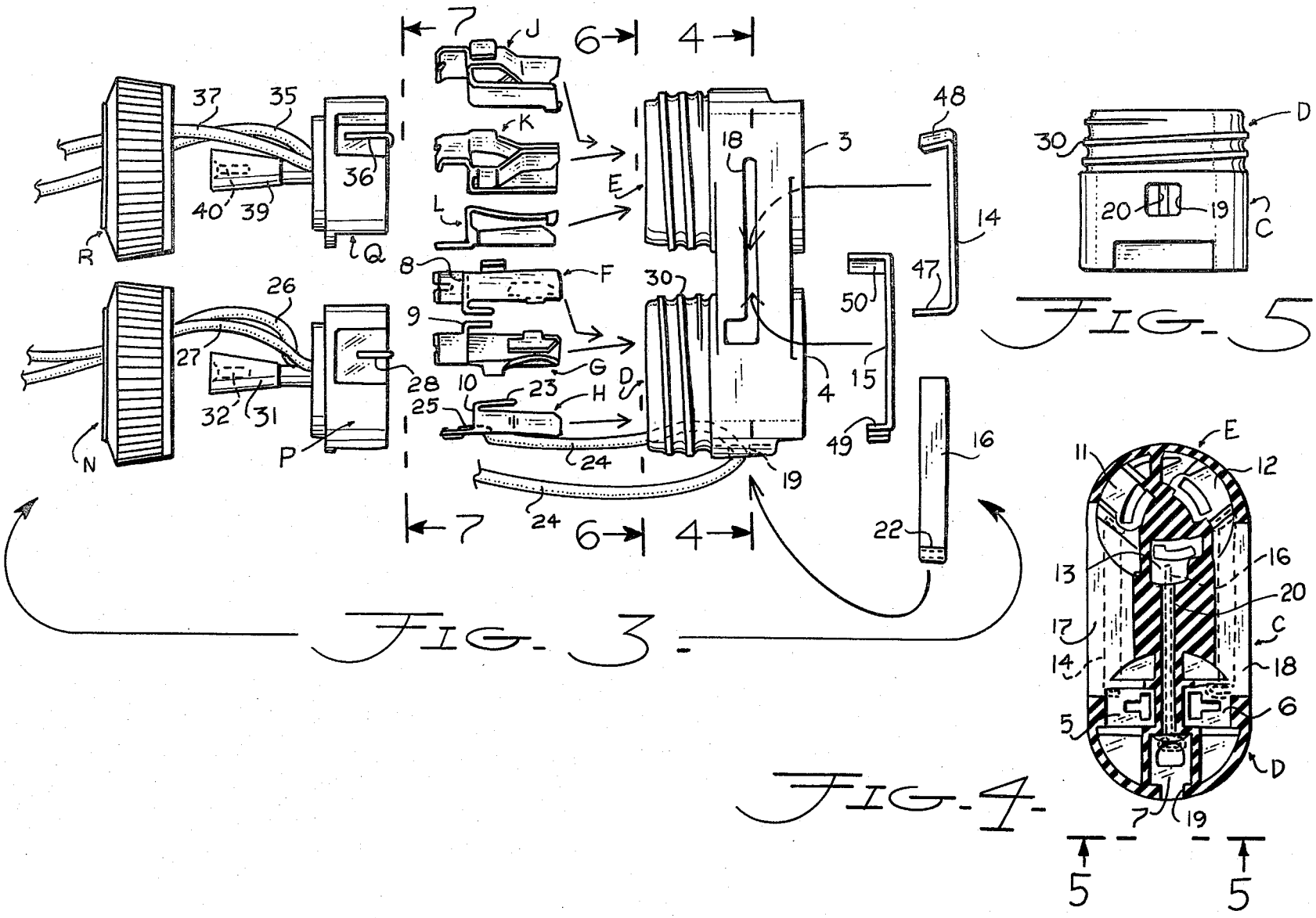
FIG. 3 is an exploded view of all of the parts making up the twin electric sockets.
FIG. 4 is a section taken along the line 4—4 of FIG. 3 and shows the twin sockets in section and the locations of the three bus bars.
FIG. 5 is an end view of the twin sockets when looking in the direction of the arrows 5—5 in FIG. 4.

I will describe the structure of the twin sockets and show how the various electrical parts are interconnected electrically. The base C has two sockets indicated generally at D and E, in FIGS. 3 and 8. Reference to FIG. 4 shows the socket D as having three recesses 5, 6 and 7 and these respectively receive three electrodes F, G, and H. These three electrodes have shoulders 8, 9 and 10, respectively, as shown in FIG. 3, the purpose of which will be described hereinafter. The recesses 5, 6 and 7 are shown in the socket D in FIG. 6, but the three electrodes F, G and H are not shown in the recesses.

The other socket E, also has three recesses 11, 12 and 13, see FIG. 6, which respectively receive three electrodes J, K and L, see FIGS. 3 and 8. A bus bar 14 electrically interconnects the electrode F to the electrode J; a second bus bar 15 interconnects the electrodes G and K; and a third bus bar 16, connects the electrode H with the electrode L. FIG. 4 shows the base C with a slot 17 for receiving the bus bar 14, and a slot 18 for receiving the bus bar 15, see also FIGS. 3 and 8. The bus bar 16 is inserted through an opening 19 in the socket D, see FIGS. 4 and 5, and then is moved through a slot 20, see FIG. 6, until the inner end of the bus bar is frictionally held by a yoke 21 which is integral with the electrode L, see FIG. 8, so as to make an electrical connection therewith. The outer end of the bus bar 16 is in the form of a loop 22 and this loop receives an integral tongue 23 on the electrode H, see FIG. 3. In this manner all three electrodes F, G, and H, in the socket D, are electrically interconnected with their associate three electrodes J, K, and L, in the socket E.

In FIG. 2 I show a cable M containing three wires, and the cable is secured to the box A, and its three wires extend into the box interior. One of the three wires is a ground wire 24 and this wire extends through the opening 19 in the socket D, and has its bare metal strands 25 electrically connected to the electrode H, as shown in both FIGS. 3 and 8. The bus bar 16 which connects the electrode H to the electrode L, constitutes a ground bus bar and makes the electrode L, act as a ground electrode if needed. The other two wires 26 and 27 from the cable M, extend through a central opening in a cap N, and are received in a wire supporting member P, with the bare wire strands 28 and 29 of these wires being electrically connected to the electrodes F and G, see FIG. 8. When the wire supporting member P, is inserted into the socket D, it will press the bare wire strands 28 and 29 against the shoulders 8 and 9 of the electrodes F and G, and form an excellent electrical connection. The cap N has a threaded interior which screws onto the threaded exterior 30 of the socket D and holds the parts in binding relation.

I have described in my copending patent application how the wire supporting member P, is provided with an axial projection 31 which in turn has an axial bore 32 for receiving a pin 33 secured to the rear wall 34 of the box A. The pin 33 centers the projection 31 and the projection bears against the wall 34 of the box and correctly positions the socket base C, in the box so that the cover B, when closed clamps the twin sockets in place.

What I have described in detail for the socket D, and its three electrodes F, G and H, holds true for the socket E, and its electrodes J, K, and L. FIG. 8 shows a wire 35 with its bare wire strands 36 electrically connected to the electrode J, and further shows a wire 37 with its bare wire strands 38 connected to the electrode K. If a ground wire, not shown, were needed for the socket E, it would be connected to the ground electrode L.

FIG. 3 shows a wire supporting member Q, similar to the member P, and receiving the wires 35 and 37. The member Q has an axial projection 39 with an axial bore 40 therein. The rear wall 34 of the box A has a pin 41 receivable in the bore. A cap R receives the wires 35 and 37 and moves the wire supporting member Q, into the socket E for binding the bare wire strands 36 and 38 against the shoulders on the electrodes J and K for forming an electrical contact therewith.

FIG. 7 illustrates the ends of the two wire supporting members P and Q. The bare wire strands 28 and 29, respectively, of the wires 26 and 27, are shown associated with the member P. Also, the member Q has the bare wire strands 36 and 38, respectively, of the wires 35 and 38. FIG. 6 shows the twin sockets D and E, without the electrodes and bus bars 14, 15 and 16. In assembling the bus bars and electrodes, the three bus bars are first placed in the positions shown in FIG. 8, after which the electrodes F and G, are placed in the recesses 5 and 6 and will be automatically and electrically connected to the bus bars 14 and 15. Then the ground electrode H, is moved into the recess 7 and will have its integral tongue 23 enter the looped end 22 of the bus bar. When the electrodes J and K are positioned in the recesses 11 and 12 of the socket E, they will be electrically connected to the opposite ends of the bus bars 14 and 15. The ground terminal L, when positioned in the recess 13 of the socket E, see FIG. 6, its integral yoke 21 will receive and make electrical contact with the ground bus bar 16. This completes the assembling of the six electrodes and the three bus bars in the twin sockets D and E.

The mounting of the wire supporting members P and Q, in their sockets D and E, will electrically connect the wires 26, 27, 35 and 37 to their associate electrodes. The caps N and R, when screwed onto the threaded portions of the sockets D and E, will firmly hold the members P and Q, in place in the sockets. FIG. 2 shows the twin sockets D and E mounted in the box A with the cover B, in closed position. Clips 42 and 43 on the cover yieldingly engage with flanges 44 and 45 on the box A and hold the cover in closed position. Screws 46 may be used for anchoring the cover from accidental removal. Both FIGS. 1 and 2 illustrate the wires 35 and 37 extending outside of the box A, and being received in a cable S.

Both FIGS. 3 and 8 show the bus bars 14 and 15 with upturned ends. The ends 47 and 48 of the bus bar 14 interconnect with the electrodes F and J and make electrical connection therewith. In like manner, the upturned ends 49 and 50 of the bus bar 15 interconnects with the electrodes G and K, and make electrical connection therewith when the electrodes are mounted in their sockets.

FIG. 1 shows the outlet end 3 of the base C provided with three openings 51 and the outlet end 4 of the base D as having three openings 52. The three electrodes J, K and L, register with the three openings 51, while the three electrodes F, G and H, register with the three openings 52.

I claim:

1. In combination:

(a) a base supporting a first socket and a second socket with each socket having three front openings;

(b) each socket having three back recesses communicating with said front openings for slidably receiving three electrodes;

(c) a first electrode mating with and mounted in a first recess in the first socket and a second electrode mating with and mounted in a first recess in the second socket, said base having a first side slot for receiving a first bus bar with laterally extending ends that electrically interconnects the two electrodes at least one of said electrodes having a projection thereon engaging the outside of an end of said first bus bar for locking the bar in position;

(d) a third electrode mating with and mounted in a second recess in the first socket and a fourth electrode mating with and mounted in a second recess in the second socket, said base having a second side slot for receiving a second bus bar with laterally extending ends that electrically interconnects said third and fourth electrodes at least one of said third and fourth electrodes having a projection thereon engaging the outside of an end of said second bus bar for locking the bar in position;

(e) a first ground electrode mating with and mounted in a third recess in said first socket and a second ground electrode mating with and mounted in a third recess in the second socket, said base having a third slot extending between said third recesses in the two sockets and through an end of one socket;

(f) a third bus bar adapted to be slid into the third slot for electrically interconnecting the two ground electrodes;

(g) said third bus bar having an integral loop at one end dimensioned to receive and tightly engage a tongue that is integral with said first ground electrode for making an electrical connection therewith, said third bus bar having the other end thereof dimensioned for frictional gripping by a yoke that is integral with the second ground electrode and forming an electrical connection therewith; and (h) first and second caps threaded on the back of said first and second sockets for retaining the electrodes therein.

2. The combination of claim 1 further defined by said side slots in said base for said first and second bus bars each having an elongated horizontal portion between said sockets and one laterally extending end toward the back of the base and said bus bars being insertable into the base by first placing a lateral end through a slot with the bus bar vertical and then pivoting the bar horizontally and rotating the bar horizontally to swing the other lateral end through the laterally extending slot end whereby subsequent insertion of said electrodes slide a projection thereon alongside at least one bus bar end to prevent the bus bars from sliding back out through the slots and subsequent threading of said caps onto the back of said sockets lock said electrodes therein.

* * * * *